US010370222B2

(12) United States Patent
Fargo

(10) Patent No.: US 10,370,222 B2
(45) Date of Patent: Aug. 6, 2019

(54) ROPELESS ELEVATOR SYSTEM AND A TRANSFER SYSTEM FOR A ROPELESS ELEVATOR SYSTEM

(71) Applicant: Otis Elevator Company, Farmington, CT (US)

(72) Inventor: Richard N. Fargo, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 361 days.

(21) Appl. No.: 15/209,240

(22) Filed: Jul. 13, 2016

(65) Prior Publication Data

US 2017/0015524 A1 Jan. 19, 2017

Related U.S. Application Data

(60) Provisional application No. 62/193,388, filed on Jul. 16, 2015.

(51) Int. Cl.
*B66B 9/00* (2006.01)
*B66B 11/04* (2006.01)

(52) U.S. Cl.
CPC ..... *B66B 9/003* (2013.01); *B66B 11/0407* (2013.01)

(58) Field of Classification Search
CPC ..... B66B 9/003; B66B 11/0407
See application file for complete search history.

(56) References Cited

U.S. PATENT DOCUMENTS 633,215 A * 9/1899 Poulson ..... B66B 9/003 198/798
1,859,483 A * 5/1932 Winslow ..... B66B 9/003 187/270
3,658,155 A * 4/1972 Salter ..... B66B 9/00 187/270
5,288,956 A * 2/1994 Kadokura ..... B66B 11/0407 187/250
5,501,295 A * 3/1996 Muller ..... B66B 9/00 187/403

(Continued)

FOREIGN PATENT DOCUMENTS

DE 1912520 A1 9/1970
EP 0885831 A2 12/1998

(Continued)

OTHER PUBLICATIONS

EP Partial Search report for application EP16179794, dated Jan. 4, 2017, U320399EP, 8 pages.

*Primary Examiner* — Michael A Riegelman
(74) *Attorney, Agent, or Firm* — Cantor Colburn LLP

(57) ABSTRACT

A ropeless elevator system includes a first lane, a second lane disposed adjacent to the first lane, and an elevator car moveable within each of the first lane and the second lane. A transfer system is configured to facilitate movement of the elevator car from one of the first lane and the second lane to the other of the first lane and the second lane. The transfer system includes a first transfer assembly arranged in at least one of the first and second lanes. The first transfer assembly is configured to guide the elevator car out of the one of the first and second lanes. A transfer station includes a second transfer assembly configured to receive the elevator car from the first transfer assembly. The second transfer assembly extends between the first and second lanes.

11 Claims, 8 Drawing Sheets

(56) References Cited

U.S. PATENT DOCUMENTS

| | | | | |
|---|---|---|---|---|
| 5,799,755 | A * | 9/1998 | Wan | B66B 9/00 187/249 |
| 5,857,545 | A | 1/1999 | Barrett et al. | |
| 7,537,089 | B2 * | 5/2009 | Duenser | B66B 1/2466 187/247 |
| 9,016,438 | B2 | 4/2015 | Altenburger et al. | |
| 10,017,354 | B2 * | 7/2018 | Ginsberg | B66B 1/28 |
| 10,059,566 | B2 * | 8/2018 | Witczak | B66B 9/00 |
| 2006/0011420 | A1 * | 1/2006 | Duenser | B66B 9/00 187/382 |
| 2006/0163008 | A1 * | 7/2006 | Godwin | B66B 9/00 187/288 |
| 2007/0181374 | A1 * | 8/2007 | Mueller | B66B 9/00 187/249 |
| 2008/0223666 | A1 * | 9/2008 | Cuthbert | B66B 11/0407 187/288 |
| 2011/0042168 | A1 * | 2/2011 | Grundmann | B66B 9/00 187/249 |
| 2011/0132693 | A1 * | 6/2011 | Altenburger | B66B 9/00 187/240 |
| 2013/0206514 | A1 * | 8/2013 | Kim | B66B 9/025 187/240 |
| 2014/0190774 | A1 * | 7/2014 | Hsu | B66B 9/003 187/406 |
| 2016/0075533 | A1 * | 3/2016 | Scomparin | B66B 9/003 187/240 |
| 2017/0015524 | A1 * | 1/2017 | Fargo | B66B 9/003 |
| 2017/0088396 | A1 * | 3/2017 | Fargo | H02K 41/031 |
| 2017/0107080 | A1 * | 4/2017 | Steinhauer | B66B 9/003 |
| 2018/0009633 | A1 * | 1/2018 | Fargo | B66B 19/002 |
| 2018/0029829 | A1 * | 2/2018 | Piech | B66B 7/04 |
| 2018/0029832 | A1 * | 2/2018 | Fargo | B66B 11/0213 |
| 2018/0257911 | A1 * | 9/2018 | Gainche | B66B 9/003 |
| 2018/0305183 | A1 * | 10/2018 | Roberts | B66B 1/2491 |

FOREIGN PATENT DOCUMENTS

| | | | |
|---|---|---|---|
| EP | 2219985 | B1 | 2/2013 |
| JP | H0952678 | A | 2/1997 |
| KR | 100271022 | B1 | 11/2000 |
| KR | 100275574 | B1 | 12/2000 |
| WO | 2005115906 | A2 | 12/2005 |
| WO | 2008136692 | A2 | 11/2008 |

* cited by examiner

ROPELESS ELEVATOR SYSTEM AND A TRANSFER SYSTEM FOR A ROPELESS ELEVATOR SYSTEM

CROSS-REFERENCE TO RELATED APPLICATIONS

This application claims the benefit of U.S. provisional patent application Ser. No. 62/193,388, filed Jul. 16, 2015, the entire contents of which are incorporated herein by reference.

BACKGROUND

Exemplary embodiments pertain to the art of elevator systems and, more particularly, to ropeless elevator systems including a transfer system.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single lane. There exist ropeless elevator systems in which a first lane is designated for upward traveling elevator cars and a second lane is designated for downward traveling elevator cars with at least two transfer stations in the hoistway used to move elevator cars horizontally between the first lane and second lane.

Transfer stations do not typically provide redundancy for transfer station operation. Therefore, the numbers of structures capable of moving elevator cars is equal to or lower than the number of lanes of the hoistway. The assumption is that in a worst case scenario, independent working carriages in the transfer station may work with a reduced number of carriages. Working with a reduced number of carriages decreases overall elevator system efficiency and may cause operation delays, as well as logistical challenges.

BRIEF DESCRIPTION

Disclosed is a ropeless elevator system including a first lane, a second lane disposed adjacent to the first lane, and an elevator car moveable within each of the first lane and the second lane. A transfer system is configured to facilitate movement of the elevator car from one of the first lane and the second lane to the other of the first lane and the second lane. The transfer system includes a first transfer assembly arranged in at least one of the first and second lanes. The first transfer assembly is configured to guide the elevator car out of the one of the first and second lanes. A transfer station includes a second transfer assembly configured to receive the elevator car from the first transfer assembly. The second transfer assembly extends between the first and second lanes.

In addition to one or more of the features described above or below, or as an alternative, further embodiments could include wherein the first transfer assembly includes at least one selectively deployable transfer system arranged in the at least one of the first and second lanes.

In addition to one or more of the features described above or below, or as an alternative, further embodiments could include wherein the at least one selectively deployable transfer system includes a first selectively deployable conveyor and a second selectively deployable conveyor.

In addition to one or more of the features described above or below, or as an alternative, further embodiments could include wherein the at least one selectively deployable transfer system includes a first selectively deployable transfer system arranged in the first lane and a second selectively deployable transfer system arranged in the second lane.

In addition to one or more of the features described above or below, or as an alternative, further embodiments could include wherein the at least one selectively deployable transfer system includes a first selectively deployable transfer system arranged in the first lane and a second selectively deployable transfer system arranged in the first lane vertically spaced from the first selectively deployable transfer system.

In addition to one or more of the features described above or below, or as an alternative, further embodiments could include wherein the second transfer assembly includes a first transfer system extending along a first axis generally horizontally from the one of the first and second lanes and a second transfer system extending along a second axis generally perpendicularly relative to the first axis.

In addition to one or more of the features described above or below, or as an alternative, further embodiments could include wherein the first transfer system includes at least one first conveyor assembly and the second transfer system includes at least one second conveyor assembly.

In addition to one or more of the features described above or below, or as an alternative, further embodiments could include wherein the at least one first conveyor assembly is selectively vertically adjustable relative to the at least one second conveyor assembly.

In addition to one or more of the features described above or below, or as an alternative, further embodiments could include wherein the at least one second conveyor assembly is selectively vertically adjustable relative to the at least one first conveyor assembly.

In addition to one or more of the features described above or below, or as an alternative, further embodiments could include wherein the transfer station is horizontally off-set relative to each of the first and second lanes.

In addition to one or more of the features described above or below, or as an alternative, further embodiments could include a linear motor system including a fixed portion mounted in at least one of the first lane and the second lane, and a moving portion mounted to the elevator car, the moving portion being configured and disposed to disengage the fixed portion during horizontal movement of the elevator car from the one of the first and second lanes.

In addition to one or more of the features described above or below, or as an alternative, further embodiments could include a guide structure extending along one of the first and second lanes and at least one roller assembly mounted to the car, the roller assembly including at least one pivot arm supporting one or more rollers that selectively engage with the guide structure.

Also disclosed is a transfer system for a ropeless elevator system including a first transfer assembly configured to guide an elevator car out of the one of a first lane and a second lane. The transfer station includes a second transfer assembly configured to receive the elevator car from the first transfer assembly. The second transfer assembly extends between the first and second lanes.

In addition to one or more of the features described above or below, or as an alternative, further embodiments could include wherein the first transfer assembly includes at least one selectively deployable transfer system arranged in the at least one of the first and second lanes.

In addition to one or more of the features described above or below, or as an alternative, further embodiments could include wherein the at least one selectively deployable transfer system includes a first selectively deployable conveyor and a second selectively deployable conveyor.

In addition to one or more of the features described above or below, or as an alternative, further embodiments could include wherein the at least one selectively deployable transfer system includes a first selectively deployable transfer system arranged in the first lane and a second selectively deployable transfer system arranged in the second lane.

In addition to one or more of the features described above or below, or as an alternative, further embodiments could include wherein the at least one selectively deployable transfer system includes a first selectively deployable transfer system arranged in the first lane and a second selectively deployable transfer system arranged in the first lane vertically spaced from the first selectively deployable transfer system.

In addition to one or more of the features described above or below, or as an alternative, further embodiments could include wherein the second transfer assembly includes a first transfer system extending along a first axis generally horizontally from the one of the first and second lanes and a second transfer system extending along a second axis generally perpendicularly relative to the first axis.

In addition to one or more of the features described above or below, or as an alternative, further embodiments could include wherein the first transfer system includes at least one first conveyor assembly and the second transfer system includes at least one second conveyor assembly.

In addition to one or more of the features described above or below, or as an alternative, further embodiments could include wherein the at least one first conveyor assembly is selectively vertically adjustable relative to the at least one second conveyor assembly.

In addition to one or more of the features described above or below, or as an alternative, further embodiments could include wherein the at least one second conveyor assembly is selectively vertically adjustable relative to the at least one first conveyor assembly.

In addition to one or more of the features described above or below, or as an alternative, further embodiments could include wherein the transfer station is horizontally off-set relative to each of the first and second lanes.

Further disclosed is a method of transferring an elevator car between elevator lanes. The method includes shifting an elevator car to a transfer station, deploying one or more selectively deployable conveyors, positioning the elevator car onto the one or more selectively deployable conveyors, shifting the elevator car from one lane upon the selectively deployable conveyors onto a transfer assembly, and guiding the elevator car to another lane on the transfer assembly.

In addition to one or more of the features described above or below, or as an alternative, further embodiments could include wherein shifting the elevator car onto a transfer assembly includes shifting the elevator car onto one or more of a first plurality of conveyor systems.

In addition to one or more of the features described above or below, or as an alternative, further embodiments could include wherein guiding the elevator car to another lane includes shifting the elevator car upon one or more of a second plurality of conveyor systems.

In addition to one or more of the features described above or below, or as an alternative, further embodiments could include wherein guiding the elevator car to another lane includes shifting the one or more of the first plurality of elevator systems relative to the one or more of the plurality of second conveyor systems.

In addition to one or more of the features described above or below, or as an alternative, further embodiments could include wherein shifting the elevator car from the one lane includes disengaging a roller assembly from a guide rail.

In addition to one or more of the features described above or below, or as an alternative, further embodiments could include wherein shifting the elevator car from the one lane includes moving the elevator car horizontally to disengage a moving portion of a linear motor assembly from a stationary portion of the linear motor assembly.

In addition to one or more of the features described above or below, or as an alternative, further embodiments could include wherein deploying the one or more selectively deployable conveyors includes rotating the one or more selectively deployable conveyors into the lane.

In addition to one or more of the features described above or below, or as an alternative, further embodiments could include wherein rotating the one or more selectively deployable conveyors into the lane includes pivoting the one or more selectively deployable conveyors upwardly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
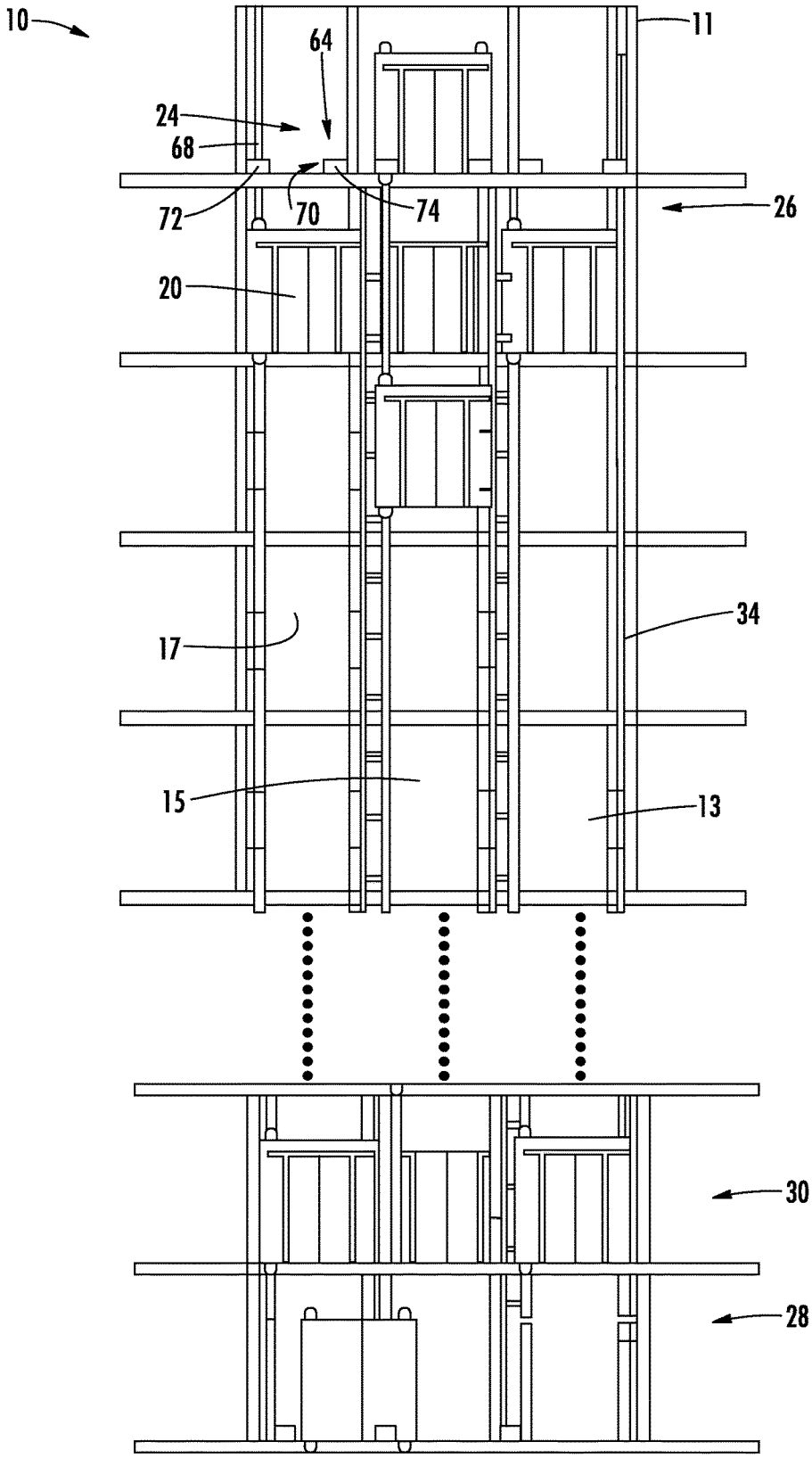
FIG. 1 illustrates a multicar ropeless elevator system, in accordance with an aspect of an exemplary embodiment.
Figure 2:
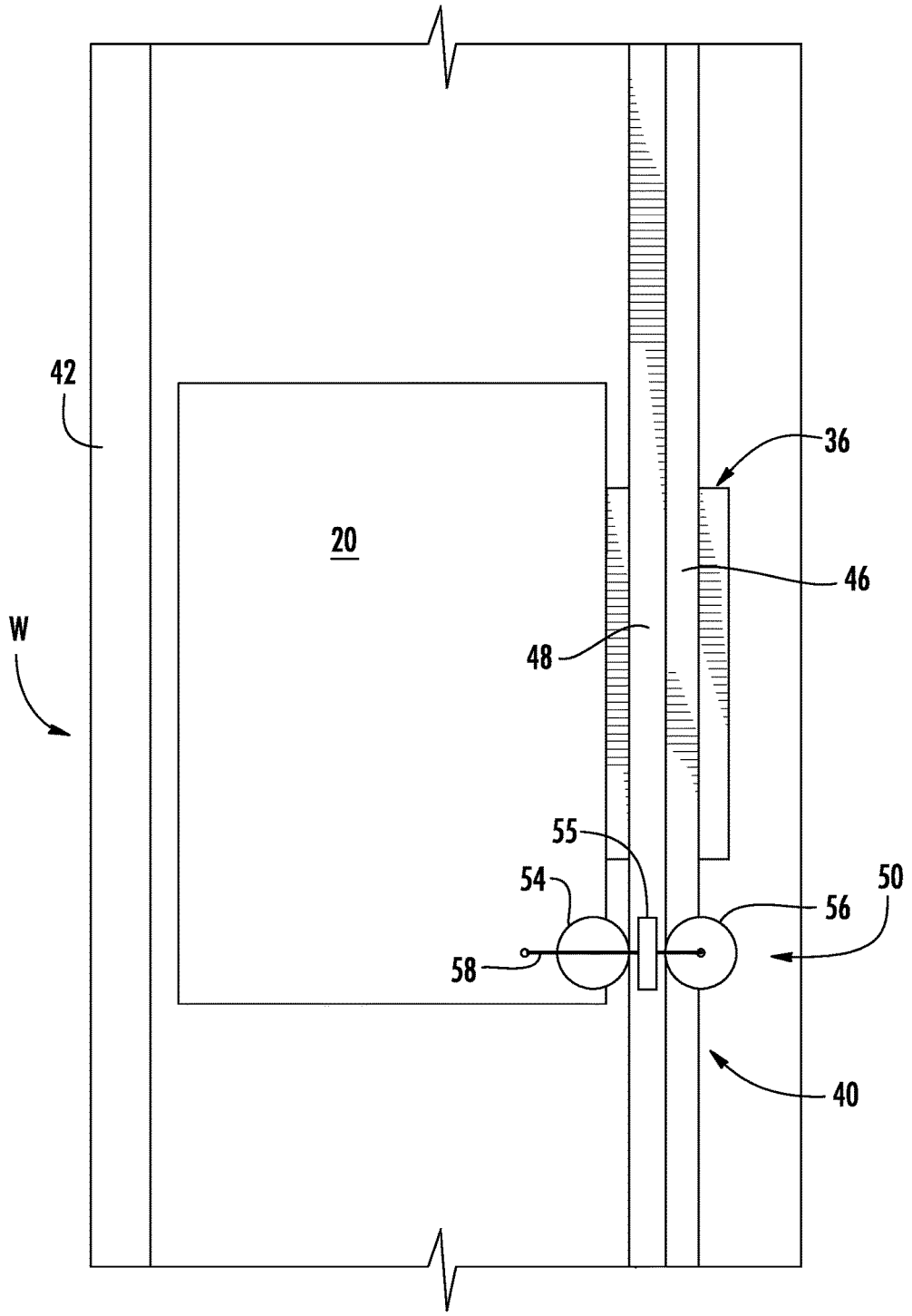
FIG. 2 is a schematic illustration of one elevator car of the multicar ropeless elevator system, in accordance with an aspect of an exemplary embodiment.

Referring to FIGS. 1 and 2, a multicar, ropeless elevator system 10 is illustrated according to one embodiment. Elevator system 10 includes a hoistway 11 having a plurality of lanes 13, 15 and 17. While three lanes are shown in FIG. 1, it is understood that embodiments may be used with multicar, ropeless elevator systems that have any number of lanes. In each lane 13, 15 and 17, elevator cars 20 travel in one direction, i.e., up or down, or in multiple directions (i.e., both up and down). For example, in FIG. 1 elevator cars 20 in lanes 13 and 17 travel up and elevator cars 20 in lane 15 travel down. One or more elevator cars 20 may travel in a single lane 13, 15 and 17.

In the exemplary embodiment shown, an upper transfer station 24 may be located above a top most floor 26. Upper transfer station 24 facilitates horizontal travel of one or more elevator cars 20 between select ones of lanes 13, 15 and 17. It is understood that upper transfer station 24 may be located at top most floor 26. A lower transfer station 28 may be arranged below a first floor 30. In a manner similar to that described above, lower transfer station 28 facilitates horizontal travel of one or more of elevator cars 20 between select ones of lanes 13, 15 and 17. It is understood that lower transfer station 28 may be located at first floor 30. Although not shown in FIG. 1, one or more intermediate transfer stations may be used between lower transfer station 28 and upper transfer station 24. Intermediate transfer stations may be similar to lower transfer station 28 and/or upper transfer station 24. Additionally, both lower transfer station 28 and upper transfer station 24 may be at system terminals, or at any floor above or below. Therefore, it is to be understood that upper transfer station 24 represents an upper most transfer station in ropeless elevator system 10, and lower transfer station 28 represents a lower most transfer station in ropeless elevator system 10. Transfer stations at various locations advantageously impact the functional capability of the system by increasing loop options. For example, the lanes 13, 15 and 17 may include elevator cars 20 traveling in a unidirectional or bidirectional manner. Furthermore, parking of elevator cars 20 may be performed in transfer stations 24 and 28 depending on the particular location and configuration.

Elevator cars 20 are self-propelled using, for example, a linear motor system 32 having one or more fixed portions or motor primaries 34 and one or more moving portions or motor secondaries 36. The one or more fixed portions 34 are mounted in and extend along lanes 13, 15 and 17. The one or more moving portions 36 are mounted on elevator cars 20. In accordance with an aspect of an exemplary embodiment, moving portion(s) 36 is positioned and arranged to disengage from fixed portion(s) 34 allowing elevator car 20 to freely translate or horizontally shift into, for example, one or the other of upper transfer station 24 and lower transfer station 28 as well as any transfer stations that may be arranged therebetween. Drive signals are provided to fixed portion 34 and/or moving portion 36 from a controller (not shown) to control movement of elevator cars 20 in a respective one of lanes 13, 15 and/or 17.

As shown in FIG. 2, elevator car 20 is guided by one or more guide structures 40 extending along the length of lane 15, where the guide structure 24 may be affixed to hoistway wall (not separately labeled), propulsion device (also not separately labeled), carriage structural member 42, or stacked over each other. For ease of illustration, the view of FIG. 2 only depicts a single side guide structure 40; however, there may be two or more guide structures 40 positioned, for example, on opposite sides of elevator car 20. Guide structure 40 includes a first guide rail 46 that supports moving portion 36 of linear motor system 32 and a second guide rail 48. Elevator cars 20 also include a roller assembly 50 that interacts with second guide rail 48 of guide structure 40.

Figure 3:
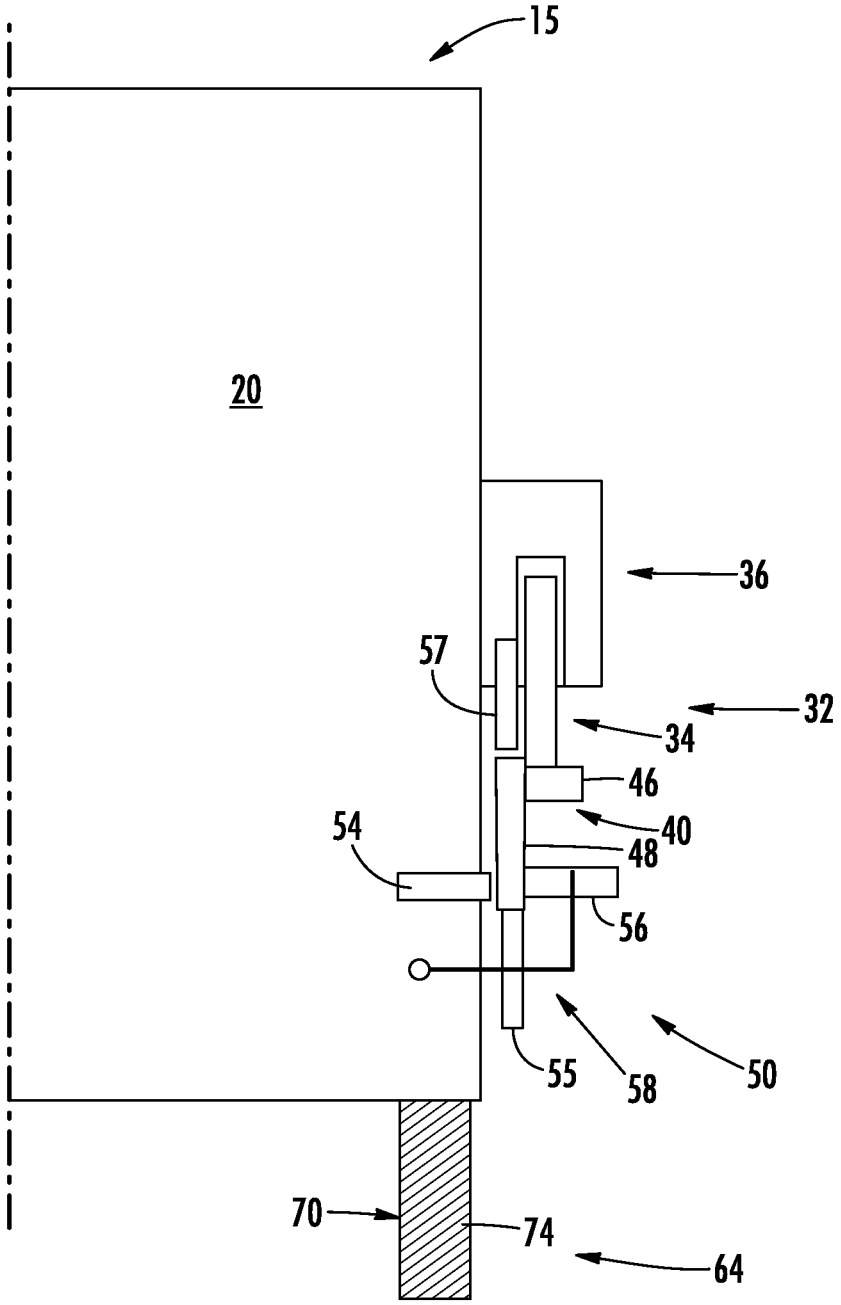
FIG. 3 is a top partial plan view of the elevator car of FIG. 2, in accordance with an aspect of an exemplary embodiment.

More specifically, as shown in FIG. 3, roller assembly 50 includes a first roller member 54, a second roller member 55, a third roller member 56, and a fourth roller member 57. Second and third roller members 55 and 56 are mounted to a pivot arm 58, while first and fourth roller members 54 and 57 are fixedly mounted to elevator car 20. Pivot arm 58, as will be discussed more fully below, disengages second and third roller members 55 and 56 from second guide rail 48 allowing elevator car 20 to freely shift into upper transfer station 24, lower transfer station 28, and/or any one of a number of intermediate transfer stations (not shown) without being constrained by connections to guide structure 40.

In accordance with an aspect of an exemplary embodiment, ropeless elevator system 10 includes a first transfer assembly 64 that guides elevator car 20 from lane 13 into a desired one of upper transfer station 24. It should however be noted that ropeless elevator system 10 may include additional first transfer assembles in lane 13 to guide elevator car 20 into lower transfer station 28, and any one of a number of intermediate transfer stations (not shown). Also, one or more first transfer assemblies (not separately labeled) may be arranged in lanes 15 and 17. First transfer assembly 64 includes a first selectively deployable transfer system 68 and a second selectively deployable transfer system 70. Each selectively deployable transfer system 68 and 70 includes a corresponding selectively deployable conveyor 72 and 74.

Figure 4:
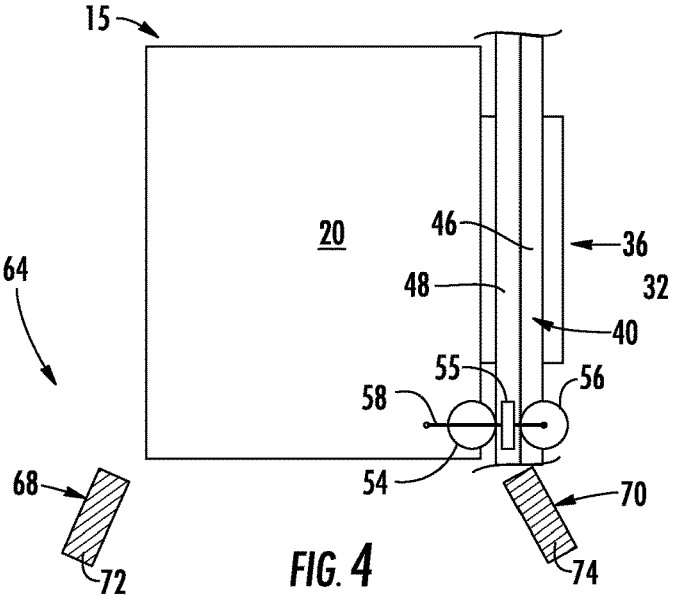
FIG. 4 illustrates the elevator car of FIG. 2 arranged above a selectively deployable transfer system in a non-deployed configuration, in accordance with an exemplary embodiment.
Figure 5:
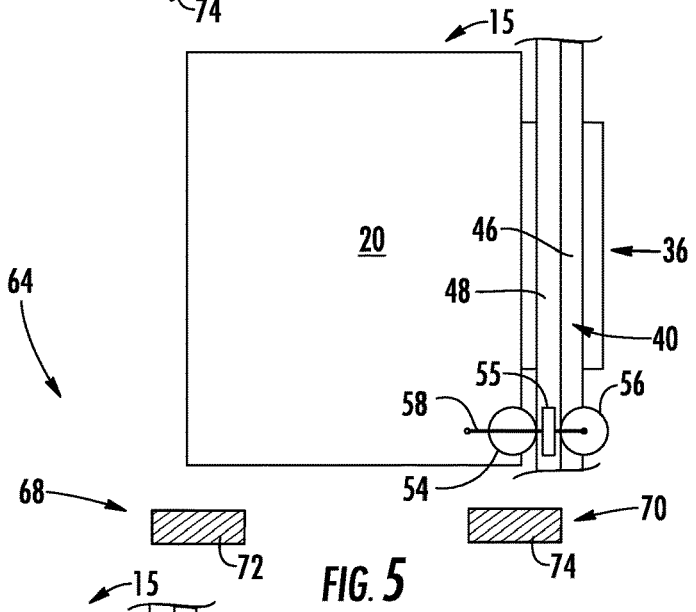
FIG. 5 illustrates the elevator car of FIG. 4 arranged above the selectively deployable transfer system depicted in a deployed configuration, in accordance with an aspect of an exemplary embodiment.
Figure 6:
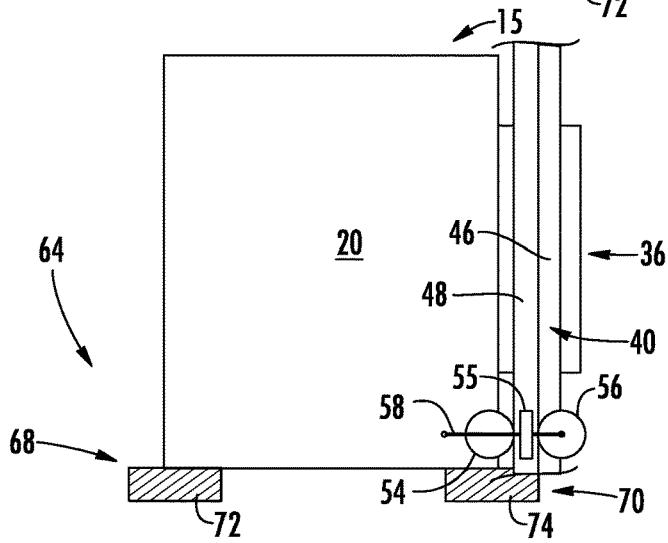
FIG. 6 illustrates the elevator car of FIG. 5 resting upon the selectively deployable transfer system, in accordance with an aspect of an exemplary embodiment.

In accordance with an aspect of an exemplary embodiment illustrated in FIGS. 4-6, first and second selectively deployable transfer systems 68 and 70 are initially in a non-deployed configuration such as shown in FIG. 4. In the non-deployed configuration, elevator cars 20 may travel along an unobstructed path along each one of lanes 13, 15 and 17. When desired to move into a transfer station, such as upper transfer station 24, elevator car 20 is moved to a position above first and second selectively deployable transfer systems 68 and 70. At this point, selectively deployable transfer systems 68 and 70 may be deployed, such as shown in FIG. 5. Once deployed, elevator car 20 may be supported by first and second selectively deployable conveyors 72 and 74, as shown in FIG. 6. At this point, it should be understood that while shown as rotating downward to deploy, first and second selectively deployable transfer systems 68 and 70 may be rotated upwardly to deploy. Selectively deployable transfer systems 68 and 70 may also be translated linearly.

Figure 7:
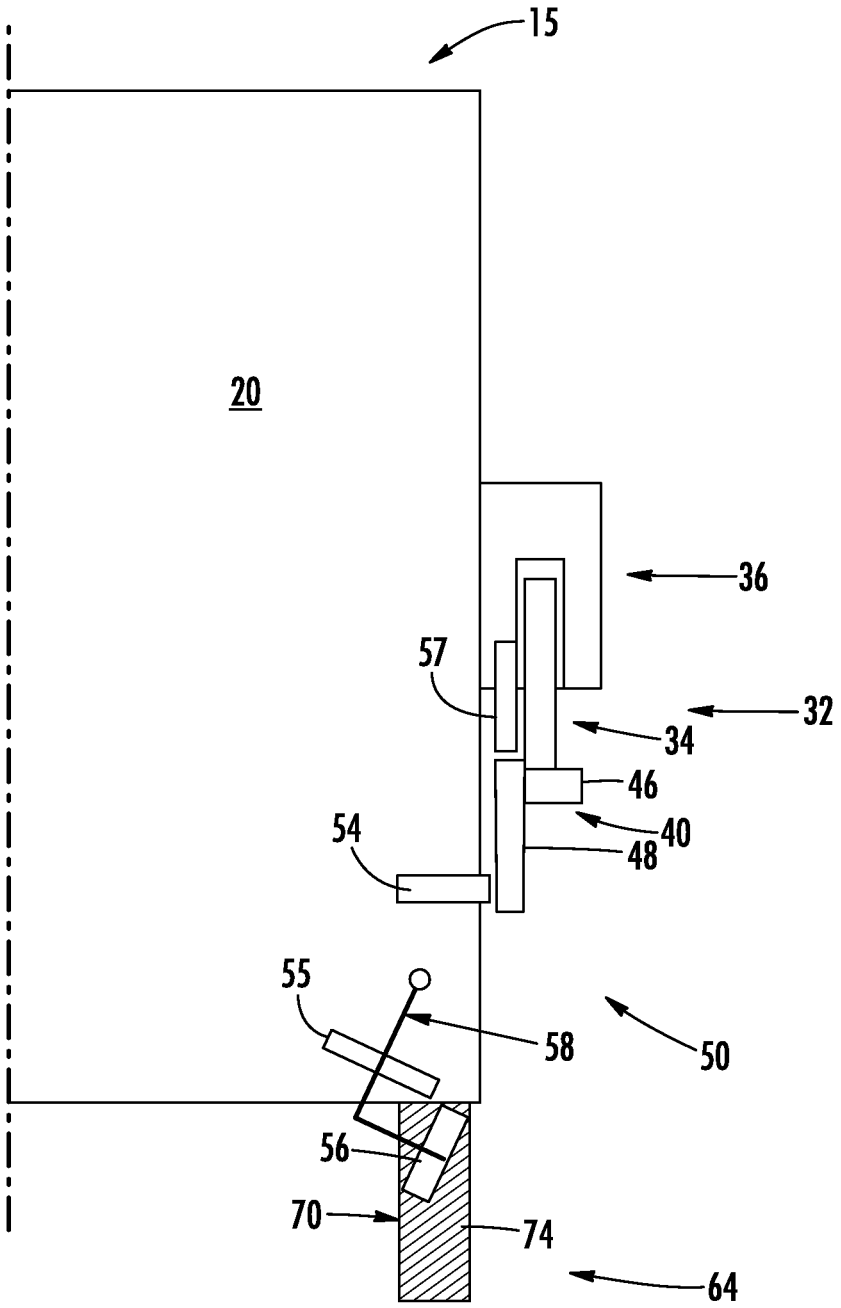
FIG. 7 illustrates a roller assembly arranged on the elevator car of FIG. 6 disengaging from a guide structure, in accordance with an aspect of an exemplary embodiment.
Figure 8:
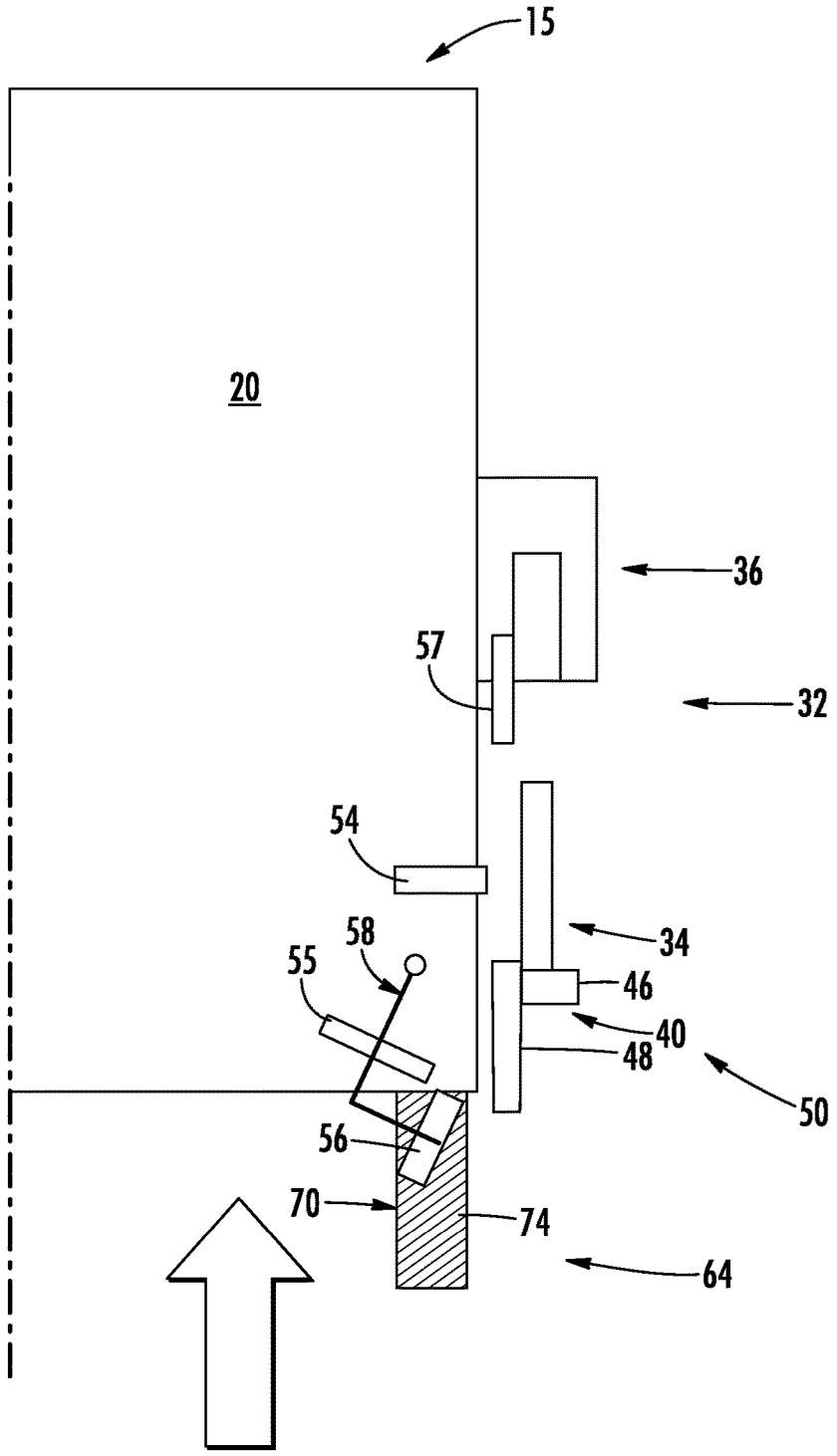
FIG. 8 illustrates the selectively deployable transfer system shifting the elevator car of FIG. 6 out of a lane, in accordance with an exemplary embodiment.
Figure 9:
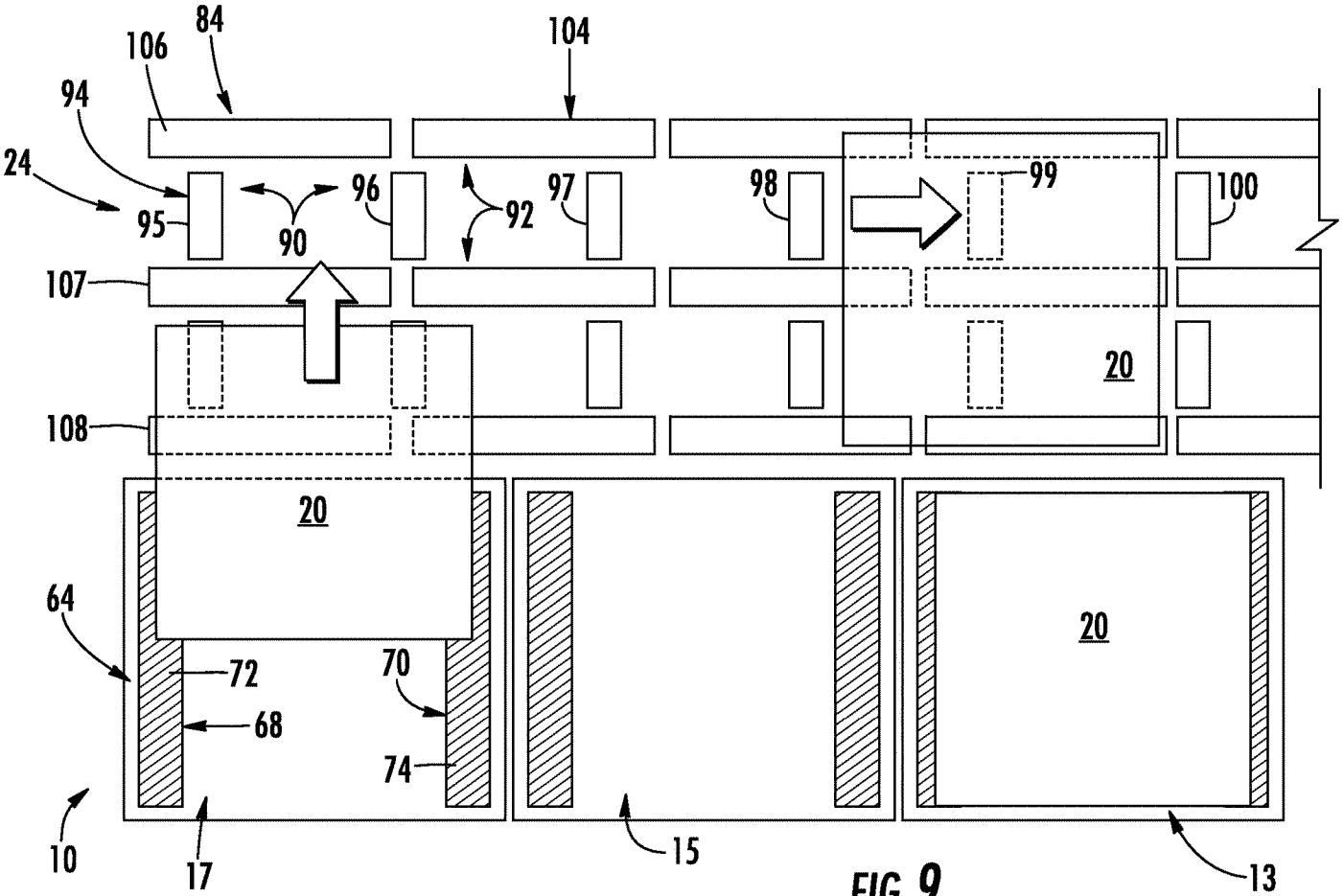
FIG. 9 illustrates the elevator car of FIG. 8 entering a transfer station and moving, upon a second transfer assembly, to another lane, in accordance with an exemplary embodiment.

In further accordance with an exemplary embodiment, once elevator car 20 is supported, pivot arm 58 may be rotated to disengage second and third roller members 55 and 56 from guide structure 40, as shown in FIG. 7. At this point, elevator car 20 may be shifted rearwardly to disengage motor secondary 36 from motor primary 34, as shown in FIG. 8. Further shifting guides elevator car 20 into upper transfer station 24, as shown in FIG. 9. Of course, it should be understood that elevator car 20 could be shifted forwardly depending upon construction preferences.

In further accordance with an aspect of an exemplary embodiment, ropeless elevator system 10 includes a second transfer assembly 84 arranged in upper transfer station 24. Of course, it should be understood that ropeless elevator system 10 may also include a second transfer assembly in lower transfer station 28 as well as any one of a number of intermediate transfer stations (not shown). Second transfer assembly 84 includes a first transfer system 90 that receives elevator car 20 along a first axis from, for example, lane 13, and a second transfer system 92 that guides elevator car 20 along a second axis, horizontally between lanes 13, 15 and 17, as shown in FIG. 9.

In accordance with an aspect of an exemplary embodiment, first transfer system 90 includes a first plurality of conveyor belt systems 95-100 that extend along the first axis. That is, first conveyor belt systems 95-100 may include one or more conveyor belts (not separately labeled) that move elevator car 20 out from a respective one of lanes 13, 15 and 17 into upper transfer station 24. Second transfer system 92 includes a second conveyor assembly 104 having a second plurality of conveyor belt systems 106-108 that extend along a second axis that is substantially perpendicular to the first axis. Second conveyor assembly 104 shifts elevator car 20 between lanes 13, 15 and 17.

Figure 10:
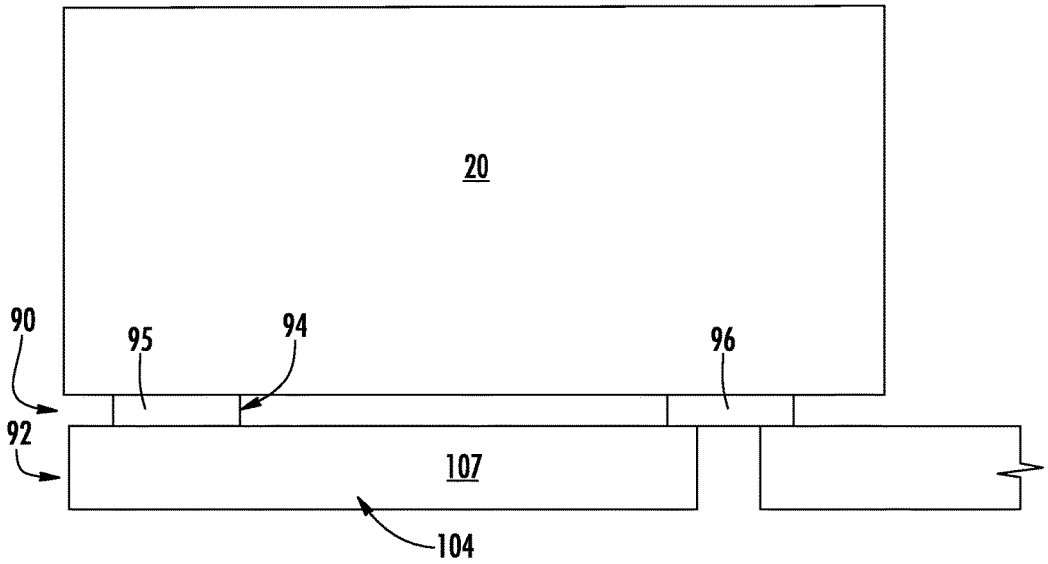
FIG. 10 illustrates the elevator car of FIG. 9 being received by a first transfer system of the second transfer assembly, in accordance with an aspect of an exemplary embodiment.
Figure 11:
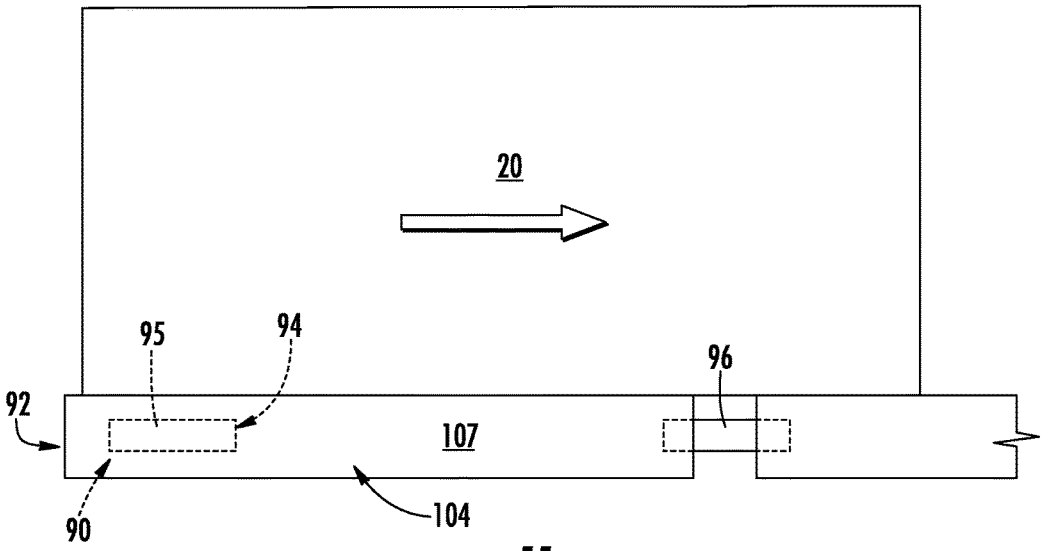
FIG. 11 illustrates the elevator car of FIG. 10 being shifted along a second transfer system of the second transfer assembly, in accordance with an aspect of an exemplary embodiment.

In further accordance with an aspect of an exemplary embodiment, first conveyor assembly 94 is selectively shiftable relative to second conveyor assembly 104. More specifically, as shown in FIG. 10, when second transfer system 92 is in an elevator car receiving mode, first conveyor assembly 94 may project proudly of second conveyor assembly 104. In this manner, first transfer assembly 64 may seamlessly guide elevator car 20 into upper transfer station 24. Once received, first conveyor assembly 94 may be lowered such that elevator car 20 rests upon second conveyor assembly 104, as shown in FIG. 11. Of course, it should be understood that second conveyor assembly 104 may be shiftable relative to first conveyor assembly 94 or both first and second conveyor assemblies 94 and 104 may be shiftable.

At this point, it should be understood that the exemplary embodiment describe a system for shifting elevator cars horizontally between any existing lanes. In this manner, one or more elevator cars may, for example, travel up in lane 13 and then travel down in lane 17 while additional elevator cars may travel in lane 15 in order to reduce elevator wait times. That is, in accordance with an exemplary embodiment, multiple elevator cars may exist in a lane. Accordingly, during select periods, more lanes may be designated as downward travel lanes and at other select periods, more lanes may be designated as upward travel lanes. Further, the exemplary embodiments provide a system that allows elevator cars to transfer between lanes without interrupting continuity of guide structure. It should be further understood, that the exemplary embodiments could be combined with other elevator car transfer systems in order to meet design and operational requirements of a structure. Still further, it should be understood that the exemplary embodiments may be employed to transfer an elevator car to a parking station and/or a maintenance location without shutting down a lane.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A ropeless elevator system comprising:

a first lane;

a second lane disposed adjacent to the first lane;

an elevator car moveable within each of the first lane and the second lane; and a transfer system configured to facilitate movement of the elevator car from one of the first lane and the second lane to the other of the first lane and the second lane, the transfer system comprising:

a first transfer assembly arranged in at least one of the first and second lanes, the first transfer assembly being configured to guide the elevator car out of the one of the one of the first and second lanes; and a transfer station including a second transfer assembly configured to receive the elevator car from the first transfer assembly, the second transfer assembly extending between the first and second lanes;

a guide structure extending along one of the first and second lanes and at least one roller assembly mounted to the elevator car, the roller assembly including at least one pivot arm supporting one or more rollers that selectively engage with the guide structure, the pivot arm configured to disengage the roller assembly from the guide structure to allow the elevator car to enter the transfer station.

2. The ropeless elevator system according to claim 1, wherein the first transfer assembly includes at least one selectively deployable transfer system arranged in the at least one of the first and second lanes.

3. The ropeless elevator system according to claim 2, wherein the at least one selectively deployable transfer system includes a first selectively deployable conveyor and a second selectively deployable conveyor.

4. The ropeless elevator system according to claim 2, wherein the at least one selectively deployable transfer system includes a first selectively deployable transfer system arranged in the first lane and a second selectively deployable transfer system arranged in the second lane.

5. The ropeless elevator system according to claim 2, wherein the at least one selectively deployable transfer system includes a first selectively deployable transfer system arranged in the first lane and a second selectively deployable transfer system arranged in the first lane vertically spaced from the first selectively deployable transfer system.

6. The ropeless elevator system according to claim 1, wherein the second transfer assembly includes a first transfer system extending along a first axis generally horizontally from the one of the first and second lanes and a second transfer system extending along a second axis generally perpendicularly relative to the first axis.

7. The ropeless elevator system according to claim 6, wherein the first transfer system includes at least one first conveyor assembly and the second transfer system includes at least one second conveyor assembly.

8. The ropeless elevator system according to claim 7, wherein the at least one first conveyor assembly is selectively vertically adjustable relative to the at least one second conveyor assembly.

9. The ropeless elevator system according to claim 8, wherein the at least one second conveyor assembly is selectively vertically adjustable relative to the at least one first conveyor assembly.

10. The ropeless elevator system according to claim 1, wherein the transfer station is horizontally off-set relative to each of the first and second lanes.

11. The ropeless elevator system according to claim 1, further comprising: a linear motor system including a fixed portion mounted in at least one of the first lane and the second lane, and a moving portion mounted to the elevator car, the moving portion being configured and disposed to disengage the fixed portion during horizontal movement of the elevator car from the one of the first and second lanes.

* * * * *